US006699330B1

(12) United States Patent
Muraoka

(10) Patent No.: US 6,699,330 B1
(45) Date of Patent: Mar. 2, 2004

(54) METHOD OF REMOVING CONTAMINATION ADHERED TO SURFACES AND APPARATUS USED THEREFOR

(75) Inventor: Hisashi Muraoka, Yokohama (JP)

(73) Assignee: Nomura Micro Science Co., Ltd., Kanagawa-ken (JP)

( * ) Notice: Subject to any disclaimer, the term of this patent is extended or adjusted under 35 U.S.C. 154(b) by 66 days.

(21) Appl. No.: 09/676,976

(22) Filed: Oct. 2, 2000

(30) Foreign Application Priority Data

Sep. 30, 1999 (JP) ..... 11-280017
Mar. 27, 2000 (JP) ..... 2000-086924

(51) Int. Cl.[7] ..... C23G 1/02

(52) U.S. Cl. ..... 134/3; 134/2; 134/19; 134/25.4; 134/26; 134/28; 134/31; 134/32; 134/33; 134/34; 134/36; 134/41; 134/42; 134/902

(58) Field of Search ..... 134/2, 3, 19, 25.4, 134/26, 28, 31, 32, 33, 34, 36, 41, 42, 902

(56) References Cited

U.S. PATENT DOCUMENTS 5,632,847 A * 5/1997 Ohno et al. ..... 134/31
6,080,531 A * 6/2000 Carter et al. ..... 430/329
6,267,125 B1 * 7/2001 Bergman et al. ..... 134/102.1
2001/0037816 A1 * 11/2001 Torek et al.
2002/0011257 A1 * 1/2002 Degendt et al.
2002/0033186 A1 * 3/2002 Verhaverbeke et al.
2002/0066717 A1 * 6/2002 Verhaverbeke et al.

FOREIGN PATENT DOCUMENTS

EP 0 867 924 A2 9/1998
JP 361004232 * 1/1986
JP 2001340817 A * 12/2001
JP 2002025971 * 1/2002

OTHER PUBLICATIONS

Patent Abstracts of Japan, vol. 010, No. 141, Publication No. 60004232.
Patent Abstracts of Japan, vol. 1998, No. 9, Publication No. 10107003.
Patent Abstracts of Japan, vol. 016, No. 488, Publication No. 04179225.

* cited by examiner

*Primary Examiner*—Sharidan Carrillo
(74) *Attorney, Agent, or Firm*—Pillsbury Winthrop LLP

(57) ABSTRACT

A method of removing surface-deposited contaminants, comprising bringing an ozone-containing treating solution into contact with the surface of a treating target on which contaminants have deposited. The ozone-containing treating solution comprises an organic solvent having a partition coefficient to ozone in a gas, of 0.6 or more, and ozone having been dissolved in the solvent. Contaminants having deposited on the surfaces of various articles including substrates for electronic devices, such as semiconductor substrates and substrates for liquid crystal display devices can be removed by room-temperature and short-time treatment in a high safety and a good efficiency.

7 Claims, 5 Drawing Sheets

METHOD OF REMOVING CONTAMINATION ADHERED TO SURFACES AND APPARATUS USED THEREFOR

BACKGROUND OF THE INVENTION

1. Field of the Invention

This invention relates to a method of cleaning articles from which contaminants must be removed, and more particularly to a method of cleaning substrates for electronic devices. More specifically, this invention relates to the removal of organic films such as photoresists used when wafers for semiconductors or substrates for liquid crystal display devices are processed, and to the cleaning of wafers to remove organic contamination caused thereon over the whole wafer processing. More broadly, it also relates to the cleaning of precision metal workpieces or glass workpieces to remove their organic contamination.

2. Description of the Prior Art

To remove photoresists used in fine processing on oxide films or polysilicon films, a method is usually used in which a mixture solution of sulfuric acid (3 or 4 parts by volume) and hydrogen peroxide (1 part by volume) (which solution is called a piranha) is heated to 110 to 140° C. and cleaning targets are immersed therein for 10 to 20 minutes. In the case when high-density ion implantation is effected via a resist mask, the resist changes in properties to become unremovable by piranha treatment, and hence ashing plasma-excited oxygen is in wide used. If, however, the whole photoresist is subjected to ashing, a trace metal due to the resist may remain on the wafer surface, and also damage which is harmful for devices may appear on the wafer surface because of high-energy plasma. Accordingly, it is common to effect ashing, leaving the resist film unremoved, followed by piranha treatment to remove the resist. In place of the hydrogen peroxide used in this piranha treatment, it has been attempted to mix ozone. However, because of a low solubility of ozone, the treatment must be made for a still longer time to remove the resist, and such a method is almost not in use.

Recently, a method of removing the resist ozone water has become available. Ozone more dissolves in water as temperature is lower. In about 5° C. ultrapure water, ozone dissolves up to a concentration as high as 70 to 100 ppm. Where the resist is removed ozone water having such a low temperature and a high concentration, it is reported that, in the case of I-ray positive novolak resin photoresist film used widely in LSI fabrication, a film of 800 nm thick can be stripped in about 10 to 15 minutes (stripping rate: 70 to 80 nm/minute).

From atmosphere in a clean room for semiconductor device fabrication, organic matters such as dioctyl phthalate (DOP), siloxanes and hexamethyldisilazane (HMDS) contaminate the surfaces of silicone wafers, oxide films and so forth. It is known that this causes deterioration of device characteristics to lower the yield of devices.

As wet-process cleaning for removing such organic matters on silicone wafers and oxide films, the above piranha treatment has been considered to be most effective. However, $SO_4^{2-}$ remains on wafers to cause fine particles under the influence of environmental atmosphere, tending to cause haze. In order to remove it completely, SC-1 treatment (standard composition: $NH_4OH:H_2O_2:H_2O$=1:1:5 part(s) by volume) is usually made subsequently. SC-1 treating solution has the action to decompose and remove organic matters even when made alone, and has ever been considered to be most greatly effective for the action to remove fine particles. In the SC-1 treatment, however, Fe, Al, Ca, Mg, Zn, Ni and the like in the treating solution tend to become deposited on wafers, and it is difficult to manage the cleanness of treating solutions and cleaning baths. Accordingly, it has become a conventional means for semiconductor cleaning to remove, dilute HF, chemical oxide films produced in SC-1 treatment and then make SC-2 treatment (standard composition: $HCl:H_2O_2:H_2O$=1:1:6 part(s) by volume), which is considered to have a good metal-removing ability. This is called the RCA method. To remove the surface residual $SO_4^{2-}$, a method is also used in which rinsing hot water in a large quantity is carried out for a long time, which, however, is inferior in the cleanness to be achievable, usually when the RCA method is made subsequently.

As cleaning methods for wafers contaminated organic matters, the treatment relying on the piranha treatment conventionally made can not be said satisfactory in view of economical advantages, productivity and safety. As a new cleaning method that can solve these problems, the method making use of ozone water has become available. This is a method in which, since ozone water having a concentration of 20 to 30 ppm is obtainable at room temperature, this oxidation power is utilized to remove organic contamination of wafers.

Higher integration of semiconductor devices, in particular, VLSI circuits, it has increasingly become important to reduce organic contamination on wafer surfaces. In roadmaps published by U.S.A. Semiconductor Industrial Society, there has been no description on surface organic carbon concentration till recently. In those published at the end of 1997, they approve a surface organic carbon concentration of $1\times10^{14}$ atoms/cm$^2$, while this concentration must be made to $1.8\times10^{13}$ atoms/cm$^2$ by 2009. Of course, this cleanness must be achieved also after the stripping of resist. Cleaning solutions for piranha treatment are repeatedly used in view of economical advantages. However, in an attempt that methyl silicon layers ascribable to HMDS in positive-resist primers are removed to such a high level of cleanness, it is difficult to do so for piranha cleaning solutions having deteriorated as a result of repeated use. Accordingly, the number of times for their use must be severely restricted. Hence, this results in an increase in the quantity of sulfuric acid used, bringing about not only an economical disadvantage but also a difficulty in waste-water disposal.

Since also the removal of the resist on a metal film may damage the film when treated with a strong acid, the treatment is made by dissolving the resist at about 70° C. for about 15 minutes using N-methylpyrrolidone (NMP) as a remover. In such a case, rinsing with ultrapure water is carried out after rinsing with an organic solvent such as isopropyl alcohol. This treatment requires to use the organic solvent in a large quantity, and is undesirable in view of economical advantage and besides costly for waste-water disposal.

Accordingly, the treatment with ozone water attracts expectation. High-purity ozone water on the level of semiconductor purpose is produced by making ozone-containing high-purity gas absorbed in ultrapure water. Now, when ozone-containing gas is injected into a container holding a liquid, and where ozone concentration in the gas is represented by $C_G$ [mg/L] and ozone concentration in the liquid standing saturated with it by $C_L$ [mg/L], a partition coefficient is given as $D=C_L/C_Q$. Here, when the liquid is water, some research information gives values of D=0.2 at 25° C., D=0.28 at 20° C. and D=0.47 at 5° C. Since the ozone concentration attained by means of a usual high-purity ozone gas generator is about 200 mg/L, calculation made thereon gives saturation concentrations of 40 ppm at 25° C. and 94 ppm at 5° C. In practical use, only concentrations a little lower than these concentrations are attained. Moreover, since ozone tends to decompose in water, the ozone concentration in an ozone water cleaning bath can not be maintained at the highest level unless ozone gas is always injected while the ozone water is circulated. Also, when there is any obstacle to flow, such as a wafer carrier, in the cleaning bath, some part on the wafer surface may come to lack in ozone to cause a decrease in resist stripping rate. Even if the resist itself can provide the stripping rate at a value of about 100 nm/minute, it takes a time twice or more the treatment time calculated from this stripping rate, in order to completely remove the resist completely up to the methyl silicon layer in respect of all wafers in the wafer carrier. More specifically, it takes 20 to 30 minutes to remove a resist film of 1 $\mu$m thick.

Meanwhile, in a clean room for semiconductors, an organic matter detected on the wafer in the largest quantity is DOP in usual instances. Its quantity may often exceed 200 ng on the Six-inch wafer surface. This DOP forms a fine-spotlike oil film on the wafer surface. Contaminant fine particles having deposited thereon are strongly captured on the surface by the action of liquid cross-linking of the oil film, and can be removed with difficulty by cleaning. This phenomenon is remarkable on the wafer's back-side surface, and in some cases such particles are in a greatly different larger quantity than those on the front-side surface. This is because, in device fabrication steps, wafers are in some cases processed in the sate the wafer backs are brought into contact with other materials such as vacuum chucks, where the surfaces of such materials are usually lipophilic and hence become contaminated with DOP or the like, and this is transferred. In semiconductor device fabrication steps, wafers are in some cases simultaneously processed in a large number in the state the back-side surface of a wafer faces the front-side surface of an adjacent wafer. In such a case, any contamination of the back with organic matters or fine particles has an adverse effect upon the device-forming surface facing thereto. Contamination with DOP or the like is known to obstruct metal contamination from being removed in the step of cleaning. The adverse effect caused by the back-side contamination also includes such metal contamination.

Under such circumstances, it is sought to solve these problems to provide an improved cleaning method.

SUMMARY OF THE INVENTION

Accordingly, an object to the present invention is to provide a method for cleaning treatment that can shorten the time taken for immersion resist stripping inclusive of complete removal of such resist primers, can also reduce the surface carbon concentration to the order of $10^{12}$ atoms/cm$^2$ after treatment, and can be effective also as a photoresist-removing method.

Another object of the present invention is to provide a method for cleaning treatment that can powerfully remove the organic contaminants on the front- and back-side surfaces of wafers and also can remove metal contaminants.

Still another object of the present invention is to provide a cleaning method also applicable to cleaning objects other than substrates for electronic devices on account of the advantages that this removal of organic-matter contamination is very powerful and also environmental pollution can be managed with ease.

To achieve these objects, the present invention first provides a cleaner for removing contaminants, comprising an organic solvent having a partition coefficient to ozone in a gas, of 0.6 or more, and ozone having been dissolved in the solvent.

The present invention second provides a method of removing surface-deposited contaminants, comprising bringing a treating solution into contact with the surface of a treating target on which contaminants have deposited; the treating solution comprising an organic solvent having a partition coefficient to ozone in a gas, of 0.6 or more, and ozone having been dissolved in the solvent.

As a preferred embodiment of the above method, the present invention also provides a method of removing surface-deposited contaminants, comprising forming a running film (i.e., a running liquid layer in the form of a film) of the above ozone-containing treating solution on the surface of a treating target on which contaminants have deposited, and bringing the ozone-containing treating solution into contact with the surface of the treating target while replenishing the treating solution continuously or intermittently to the running film to move the solution in the form of a film.

This method is attributable to a specific organic solvent such as acetic acid in which ozone is soluble in a quantity about 10 times that in water, which is a quantity large enough even for the ozone in the running film to act on the surface-deposited contaminants. As long as the ozone concentration in the atmosphere coming into contact with the running film is higher than the equilibrium concentration with respect to ozone in the solution, the ozone readily diffuses into the running film and the ozone concentration in the solution increases up to nearly a saturation point in a short time.

Accordingly, as another preferred embodiment of the above method, the present invention still also provides a method of removing surface-deposited contaminants, comprising forming a running film of the above organic solvent on the surface of a treating target on which contaminants have deposited, and bringing the ozone-containing treating solution into contact with the surface of the treating target while replenishing the organic solvent continuously or intermittently to the running film to move the solution in the form of a film.

The present invention further provides an apparatus for removing contaminants having deposited on the surface of a treating target, the features of which will become apparent from the following description.

DESCRIPTION OF THE PREFERRED EMBODIMENTS

Figure 1:
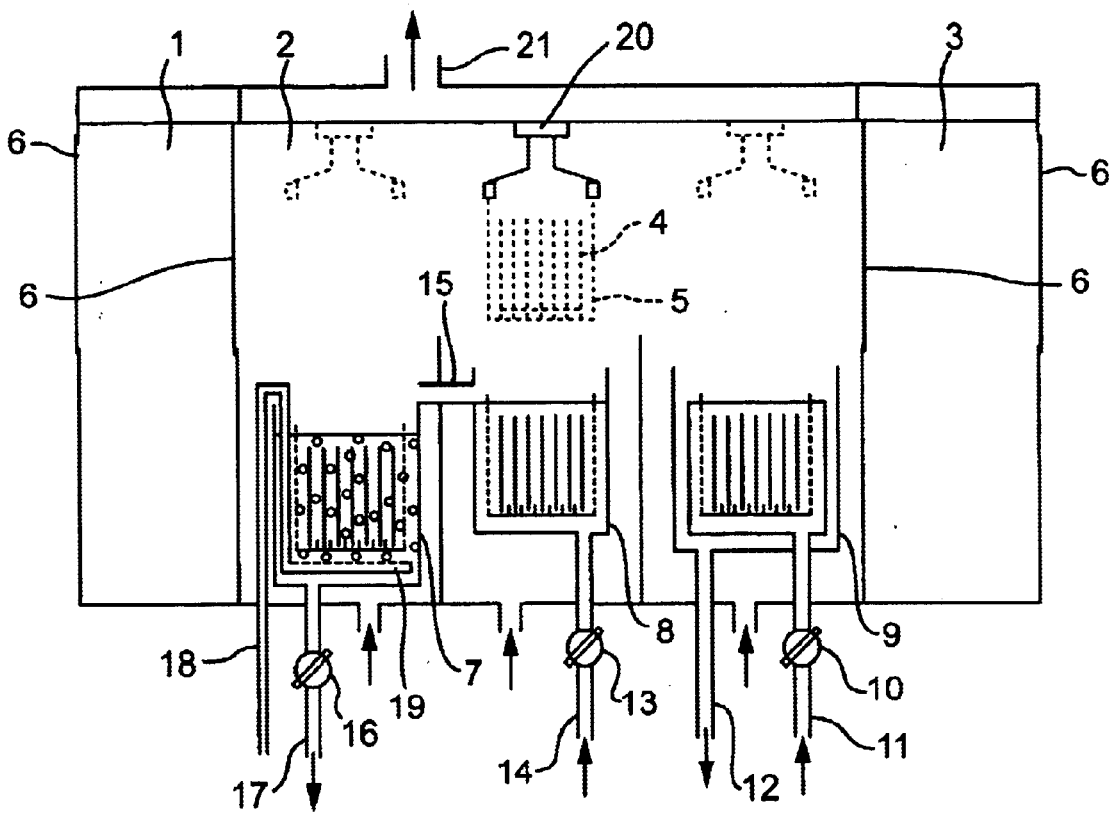
FIG. 1 is a diagrammatic illustration of an instance where the present invention is carried out by immersion of treating targets.

The present invention provides a treating method and apparatus in which, when surface-deposited contaminants are removed, an ozone-containing organic solvent solution having been used in cleaning treatment is returned to and combined with the organic solvent in which ozone is to be dissolved, and is fed as a treating solution for cleaning a treating target so that the organic solvent can be used circulatingly. Organic solvents such as acetic acid are less decomposed by ozone. For example, acetic acid is one of substances most stable to ozone in conventional organic solvents, and yet is capable of dissolving ozone in a high solubility. The ozone dissolved therein not only has a high reactivity to organic matters having unsaturated bonds to have the action of decomposition, but also, as long as there is an ample time for reaction, may finally decompose them into, e.g., carboxylic acids, carbon dioxide and water which are stable to ozone. More specifically, in this circulating process, a purification that is necessary for the cleaning treatment is effected, and the lifetime of the treating solution for cleaning can be made longer. Thus, the most characteristic and effective treatment of the present invention can be made, promising very great economical advantages.

This organic solvent solution may be fed by spraying the solution, where the movement of solution in the form of a film (i.e., running film) may be flow-down, or a flow formed by centrifugal force. Also, this solution may be fed as the result that a vapor generated from the solution having been heated liquefies on the surface of a cooled treating target. In such a case, the deposited contaminants are removed in a vapor cleaning mechanism utilizing the flow-down of liquid produced by condensation. Thus, the present invention also provides an apparatus for removing contaminants having deposited on the surface of a treating target in which apparatus the movement of the running film on the treating target surface by the feeding of such an organic solvent solution is effected in a chamber into which ozone gas is introduced.

In the present invention, when the contaminants having deposited on the surface of a treating target are removed with an organic solvent, molecules of the organic solvent becomes adsorbed conversely a little on the treating target surface. They, however, are in an adsorption on the level as low as $10^{13}$ to $10^{14}$ atoms/cm$^2$ as carbon concentration. This is due to the fact that, even though the organic solvent contained in the solution brought into contact with the treating target is an organic matter, carbon atoms are present in the molecule in a small quantity and also the ozone present together is in a very high concentration. This is most characteristic of the present invention. Also, the organic matter thus adsorbed has a weak adhesion to the treating target, and the carbon concentration can further be lowered to the order of as low as $10^{12}$ atoms/cm$^2$ with ease by oxidative treatment. The oxidative treatment may include, e.g., oxidative cleaning such as cleaning with alkali-hydrogen peroxide, and oxidizing treatment with ozone under irradiation by ultraviolet rays of 184.9 nm and 253.7 nm. Also, when the treating target surface is comprised of silicon oxide film, the surface layer may slightly be stripped with dilute hydrofluoric acid, whereby the adsorbed molecules can be removed to a carbon concentration level close to the foregoing.

In the present invention, an organic solvent having a partition coefficient to ozone in a gas, of 0.6 or more, is used, which is commonly a non-polar organic solvent. The partition coefficient, D, refers to a partition coefficient of ozone between the organic solvent that is in a liquid phase in a standard condition and an inert gas in a gaseous-phase condition that comes into contact with the organic solvent. More specifically, it is represented as:

$D$=saturated ozone concentration in organic solvent (mg/L)/equilibrium ozone concentration in gas (mg/L).

The organic solvent used in the present invention may preferably have a partition coefficient of 1.0 or more, more preferably 1.5 or more, and still more preferably 2.0 or more.

Any organic solvents may be used in the present invention without any particular limitations as long as they are organic solvents having a partition coefficient to ozone in a gas, of 0.6 or more. Organic solvents preferable in view of influences on environment, sanitation and so forth are fatty acids (carboxylic acids) represented by the formula: $C_nH_{2n+1}$(COOH) (n is an integer of 1, 2 or 3), and dichloromethane. The former fatty acids are particularly preferred. The fatty acids may include acetic acid, propionic acid and butyric acid. Any of these organic solvents may be used alone or in the form of a mixture of two or more.

In the present invention, the treating solution may preferably be in an ozone concentration of 100 ppm or higher, and more preferably 200 ppm or higher. If it is in an ozone concentration lower than 100 ppm, no sufficient contaminant removing action may be attained in some cases.

The fatty acids as described above and those having a purity of 99.7% have a partition coefficient D of about 1.9 at 25° C., and hence an ozone solution having a concentration about 10 times higher than that of pure water is obtainable. Hence, they exhibit a contaminant removing ability much higher than that of ozone water. The cleaning treatment may be made by immersing the treating target in this ozone solution, but may preferably be made by treatment with its running film, utilizing the feature that these organic solvents have a very small surface tension, which is 30 dyn/cm or smaller. The solution readily spreads in the form of a film over the whole treating target surface. Here, the movement of the solution is accompanied with simultaneous movement of the surface-deposited contaminants having undergone the action of the solution, so that the removal proceeds in a good efficiency. Any fine particles caught by deposited organic matters are also readily removed because the organic matters, having a small surface tension, dissolves and the resultant solution moves.

Of these carboxylic acids, the acetic acid, n=1, is preferred in view of price, commercial availability for high-purity products, and toxicity. It has a melting point of about 16° C., and may be difficult to handle in some aspect, but has no problem at usual clean room temperatures and is advantageous in respect of its recovery as stated later. The propionic acid, n=2, has a melting point of about −20° C., and hence any treating targets liable to be attacked by acids can be subjected to low-temperature treatment where the acid acts weakly and the ozone can be in a high concentration. The butyric acid, n=3, has an ignition point of 72° C., which is higher by about 20° C. than the acetic acid or propionic acid. When the reaction should be accelerated by heating, the treatment may be made at a temperature close to 70° C., avoiding a danger.

The acetic acid, when it contains water slightly, may more readily dissolve organic salts and also can be used with greater ease because of its lower freezing temperature. Ozone solutions with a sufficiently high concentration can be obtained as D=1.7 even in a purity of 97%, D=1.5 even in a purity of 95%, D=1.3 even in a purity of 90%, and D=1.1 even in a purity of 85%. Hence, metal contaminants can simultaneously be well removed when water containing 5% by volume of an inorganic acid, in particular, hydrofluoric acid is added to the acetic acid. Since such high D-values are obtainable, acetic acid of 85% or higher purity may be bubbled with ozone gas through a large number of fine holes, the ozone gas being generated in a high-purity ozone gas generator, whereby the ozone concentration in solution can be 100 ppm or higher even when the ozone concentration in gas is about 100 mg/L, which is applicable in the present invention. The ozone concentration in solution becomes 200 ppm or higher in few minutes when ozone gas with an ozone concentration of 200 mg/L is used.

As an exhalation means for bubbling with the ozone gas, a glass filter may be used, whereby the ozone concentration can be brought to a concentration close to saturation in about 5 minutes, and can be enhanced up to nearly 400 ppm.

Where an ozone gas with an ozone concentration of 300 mg/L is used, the ozone concentration in solution increases proportionally according to the Henry's law. Even when the water content in acetic acid is made larger to 30% to make treatment, especially making much more of the safety of a treating apparatus, the ozone concentration in solution becomes 200 ppm or higher, and the effect of cleaning treatment of the present invention can sufficiently be obtained. The solution having such an ozone concentration is in very clear bluish purple. Density of this color correlates positively with ozone concentration, and hence the ozone concentration in solution can be managed at a predetermined value by simple colorimetry.

When it is not desired to use acids or water-soluble solvents having a possibility of causing corrosion after treatment, dichloromethane is preferred as the organic solvent. It has a partition coefficient of D=2.0, may hardly cause ozone to decompose, and has a relatively low toxicity. Also, dichloromethane is suited when the present invention is practiced by means of a vapor cleaning mechanism. When practiced in a solution of mixture with acetic acid, the contaminants can be removed much more effectively.

In the case when a carboxylic acid is used in the present invention, substrates for electronic industry are most suited as treating targets. Any deposited contaminants appearing upon adsorption from environmental atmosphere or upon contact with organic materials can be removed with ease. In particular, positive novolak resin resists on silicon oxide films can be removed at a stripping rate of 1 $\mu$m/minute to 6 $\mu$m/minute, which is higher by nearly two figures than the conventional. In the case of dichloromethane, metal workpieces or glass workpieces are suited as treating targets, and in water-drop contact angle evaluation a cleaned surface superior to the case of sole use is obtainable when oily contaminants or pitch and wax are removed. The treating targets may preferably be in the shape of sheets or plates, but not limited thereto as long as the running film may move unevenly.

In practicing the present invention, the treatment must be made in a chamber or draft (draft chamber) kept hermetic so that harmful ozone gas may not contaminate environmental atmosphere. Although the organic solvent may relatively less vaporize because of room-temperature treatment, any external contamination due to such vaporization can also be prevented at the same time. An exhaust tube extending from this hermetically closed chamber is connected to an ozone decomposer that utilizes irradiation by ultraviolet rays of 253.7 nm or treatment with an alkali solution. In the course of this exhaust system, a cooling mechanism may be provided so that the organic solvent can be recovered by liquefaction. In the case when acetic acid is used, it ices or freezes with ease and hence can be recovered at a high percentage. Thus, the present invention can be practiced almost without contamination of environment.

To make resist-removing treatment according to the present invention, wafers may be put in a carrier and in that state may be immersed in ozone-containing acetic acid, where any influence of the carrier as in the case when immersed in ozone water can be small because of a high resist stripping rate, and resists can uniformly be stripped up to peripheral areas. Since, however, the treating solution is repeatedly used in the case of immersion treatment, the dissolved substances may precipitate on the wafer surface to cause contamination conversely, if the wafers having been treated are immediately put into a pure-water rinsing bath. Accordingly, an acetic-acid rinsing bath must be used, so that the treating solution in the apparatus is in too large a quantity.

On the other hand, in the treatment utilizing the running film (hereinafter often "running-film treatment") in the present invention, the ozone is in so high a concentration that the treating solution can quickly react against contaminants even in a small quantity, and also contaminants having dissolved come away from treating targets with time as the solution moves. Hence, a higher ability of removal than immersion treatment can be achieved. The movement of the solution in the form of a film utilizes flow-down of the solution, or its spread by centrifugal force from the center of a treating target. The movement of the solution may be as slow as 1 to 3 mL per minute as feed quantity on a six-inch wafer, and is sufficient at such a speed. As the apparatus, it may be set up in the same manner as conventional spray cleaning apparatus, sheet-by-sheet spin-cleaning apparatus or vapor cleaning apparatus.

In the running-film treatment that is a characteristic feature of the present invention, in order to make high its ozone concentration quickly and also maintain the concentration, it is effective to provide a chamber of the above apparatus with ozone gas inlet and outlet (exhaust vent) and fill the chamber with ozone gas; this is another characteristic feature of the present invention. It, however, is not particularly necessary to introduce ozone gas into the chamber, when a high-concentration ozone gas having an ozone concentration higher than 200 mg/L is used.

EXAMPLES

Ozone gas used in the following Examples is an ozone gas having an ozone concentration of about 200 mg/L which is obtained by flowing into a small-sized discharge type ozone generator 0.5 to 2 L/minute of oxygen containing 1% of nitrogen. As acetic acid in which ozone gas is absorbed, one having a purity of 99% (the remainder is water) is used. Photoresist films to be removed by the treatment in the respective Examples have a thickness of 800 nm or 1.5 $\mu$m, which are formed on p-type silicon wafers provided with an oxide film of 100 nm thick. Processing to form the photoresists was carried out in a standard procedure by means of a coating apparatus, taken in conventional LSI steps. First, wafers were coated with HMDS, and then processed at 100° C. for 1 minute including vacuum drawing, followed by cooling to room temperature. Thereafter, a novolak resin resist was coated in the above thickness. The thin resist film was baked at 140° C. for 1 minute, and the thick one at 90° C. for 2 minutes. For the latter, samples ion-implanted at a high dose were also prepared.

Since in high-degree VLSI it is desired for organic matters to remain only in a very small quantity ($2\times10^{13}$ atoms/cm$^2$ or less as organic carbon concentration) after the stripping of resists, the quantity of organic matters remaining on silicon oxide films after the stripping of resists in the following Examples was determined as an absolute quantity of surface organic carbon by high-sensitivity charged-particle activation analysis disclosed in Japanese Laid-open Publication (Kokai) No. 2000-39410.

The cleaning effect against organic contamination on silicon wafers in the present invention was ascertained using samples contaminated intentionally strongly with organic matters and by the same charged-particle activation analysis as the above to examine whether or not the residual organic carbon concentration sufficiently decreased after cleaning. Also, since the greater part of contaminants which contaminate silicon wafers in clean rooms of semiconductor factories is known to be DOP, DOP labeled with $^{14}$C was synthesized, and silicon wafers contaminated intentionally with this were used. The residue after cleaning was determined by measuring radioactivity by radioluminography making use of an imaging plate.

When the contaminants having deposited on planes are oils and fats and oils or HMDS, the planes have a large water-drop contact angle. Accordingly, the cleaning effect against such contaminants was also judged by whether or not the water-drop contact angle became small to about few degrees.

Example 1

An apparatus by means of which a plurality of wafers with photoresist films, put in a carrier, are immersed in an ozone acetic acid solution to remove the films is diagrammatically illustrated in FIG. 1. A draft set up for experiment is partitioned into a front chamber 1, a treating chamber 2 and a rear chamber 3, and has a glass door on the front. During operation, the inside of the draft is isolated from the outside, and operation is all controlled on the outside. An air displacement mechanism (not shown) and an open-close doorway 6 are provided in the front chamber 1 and the rear chamber 3 so that a carrier 5 made of quartz glass which can hold wafers 4 by seven sheets can be put in the treating chamber 2 through the front chamber 1 and can be taken out of the draft through the rear chamber 3; the air displacement mechanism being provided in order that the atmosphere containing ozone and acetic acid in the treating chamber 2 is kept from leaking outside the draft.

A quartz glass bath 7 is a bath in which ozone treatment is made in acetic acid, and a quartz glass bath 8 is an acetic-acid rinsing bath. Also, a quartz glass bath 9 is an overflow rinsing bath, and is so designed that ultrapure water can be fed through a feed pipe 11 having a valve 10 and discharged through a discharge pipe 12.

Acetic acid is fed to the rinsing bath 8 from a feed pipe 14 having a valve 13, and the acetic acid with which the rinsing bath 8 is filled enters the ozone treating bath 7. Acetic acid having been brought through wafer treatment is little by little discharged to a waste liquor tank (not shown) through a waste liquor pipe 17. In each bath, the treating solution is in a quantity of about 5 L.

Into the ozone treating bath 7, ozone is introduced through a quartz glass pipe 18. An end portion of this pipe is disposed at the bottom of the bath, and is provided with a large number of gas exhalation fine holes. Here, ozone gas was fed at a rate of 2 L/minute, so that the ozone concentration in acetic acid reached 200 ppm or higher in 5 minutes.

The carrier in which wafers with resist films of 800 nm thick were set was attached to a robot arm 20 in the front chamber 1, and immersed for 1 minute in the ozone treating bath 7, which is an ozone acetic acid bath having an ozone concentration of 200 ppm or higher. Then, this was rinsed in the acetic acid rinsing bath 8 for 1 minute, and was left above the rinsing bath for 30 seconds so that acetic acid drops dropped until the wafer surfaces became covered with thin acetic acid films, where the wafers were transferred to the overflow rinsing bath 9, an ultrapure water bath, and overflow-rinsed for 3 minutes. Then, the carrier holding the wafers was taken out in the rear chamber 3. The wafers were spin-dried, and then examined with the naked eye to find that the resist was not seen to remain over the whole surface.

The wafers were each cut into chips of 2 cm×2 cm, which were then put to charged-particle activation analysis to reveal that the surface organic carbon concentration was $4\times10^{14}$ atoms/cm$^2$. The resist has been removed, but there is a possibility that the acetic acid molecules stand adsorbed and besides the methyl silicon layer remains in part. It, however, follows that this ozone acetic acid treatment provides a stripping rate of 800 nm/minute or higher against the novolak resin resist, i.e., has a stripping ability higher by at least one figure than the ozone water treatment.

Figure 2:
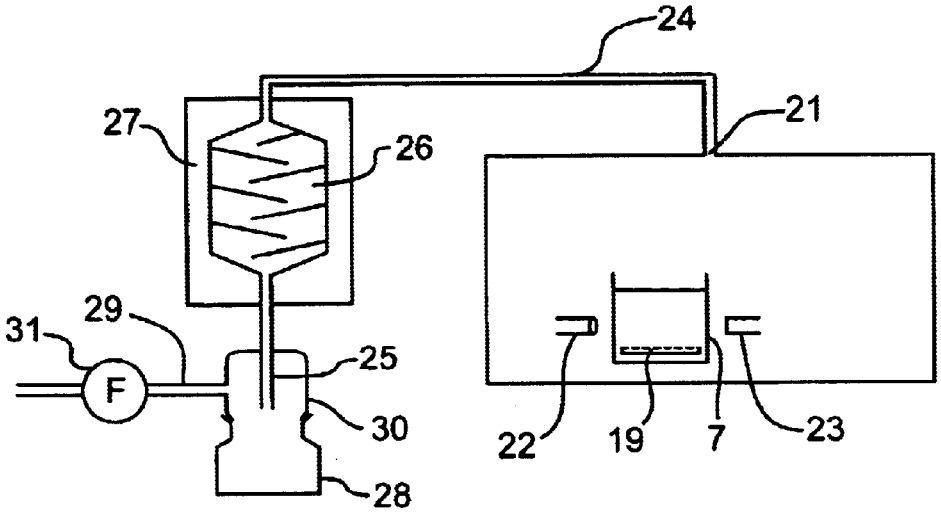
FIG. 2 is a diagrammatic illustration relating to the treatment of ozone exhaust gas containing acetic acid.

The acetic acid vapor and ozone gas generated in the draft are discharged from the exhaust tube 21 by means of a fan, and are treated for exhaustion as diagrammatically shown in FIG. 2. Where the ozone concentration in acetic acid has become higher than 100 ppm, the bluish purple attributable to ozone becomes clear. Density of this color correlates positively with ozone concentration. Hence, the discharging of harmful ozone can be managed to a minimum by stopping the feeding of ozone gas once the ozone concentration has reached a predetermined value while absorbance for light of 595 nm in wavelength is measured by the aid of a light source 22 and a light-receving member 23.

A discharge tube 24 connected to an exhaust vent extends up to a freezing chamber 26 having a flow-out tube 25. The freezing chamber 26 is held in a heat exchanger 27 which can effect not only cooling but also heating. The flow-out tube 25 projects into a sealed tube 30 to which an acetic acid recovery tank 28 is detachably connectable and also an ozone exhaust tube 29 is attached. A fan 31 is connected to the ozone exhaust tube 29. In operating the present Example, the atmosphere in the hermetically closed draft is drawn out by means of this fan 31. Here, the heat exchanger 27 is driven to lower freezing-room internal temperature to 10° C. or below to cause the acetic acid which is being drawn out, to freeze in that chamber. The acetic acid having frozen is melted by heating and collected in a tank after a series of operation has been completed.

The exhaust having passed through the fan 31 is introduced into a 253.7 nm ultraviolet ray irradiator using a low-pressure mercury-vapor lamp, where the ozone and the acetic acid having remained slightly are decomposed. In the present Example, any smell of ozone and smell of acetic acid were not perceived at all in the atmosphere outside the draft.

Example 2

The immersion in ozone acetic acid for 1 minute in Example 1 resulted in a little large organic carbon residue.

Accordingly, the treatment was made at the same ozone concentration of 200 ppm or higher but carrying out the immersion for 10 minutes. Also using wafers with 1.5 μm thick resists ion-implanted at a high dose, the following six types of samples with addition of a wafer not coated with any resist as a control were set in the carrier. Here, for the purpose of removing acetic acid molecules adsorbed on the surfaces, the pure-water rinsing bath 9 was changed for an overflow rinsing bath provided with a 1 MHz ultrasonic vibrator at its lower part, where the treatment was made for 10 minutes.

(1) A wafer with 800 nm thick resist.
(2) A wafer with 1.5 μm thick resist.
(3) A wafer $B^+$ ion-implanted in a dose of $1\times10^{14}/cm^2$ at 30 keV.
(4) The wafer (3) but subjected to ashing by 1 μm.
(5) A wafer $B^+$ ion-implanted in a dose of $1\times10^{15}/cm^2$ at 30 keV.
(6) The wafer (5) but subjected to ashing by 1 μm.

On the wafers having been treated, no resist remained in the naked eye examination except that the resist clearly remained on the wafer (5), ion-implanted in a dose of $1\times10^{15}/cm^2$. However, dust counting on the surface revealed that the resist desorbed from the $1\times10^{15}/cm^2$ ion-implanted resist film caused contamination remarkably. Accordingly, the treatment was again made excluding the sample (5). As a result, the number of fine particles of 0.2 μm or larger was 15 or less. The charged-particle activation analysis revealed that the organic carbon concentration was (7 to 10)$\times10^{13}$ atoms/$cm^2$ in all samples. Thus, it is presumed that the resist was completely removed, including the one ion-implanted in a dose of $1\times10^{14}/cm^2$ at 30 keV, and the methyl silicon layer was also removed in its greater part.

These wafers was subsequently subjected to the SC-1 cleaning with $NH_4OH:H_2O_2:H_2O$=1:1:12 part(s) by volume, whereupon the residual organic carbon concentration came to be (4 to 7)$\times10^{12}$ atoms/$cm^2$ in all samples, thus both the methyl silicon layer and the adsorbed acetic acid were completely removed.

Example 3

Figure 3:
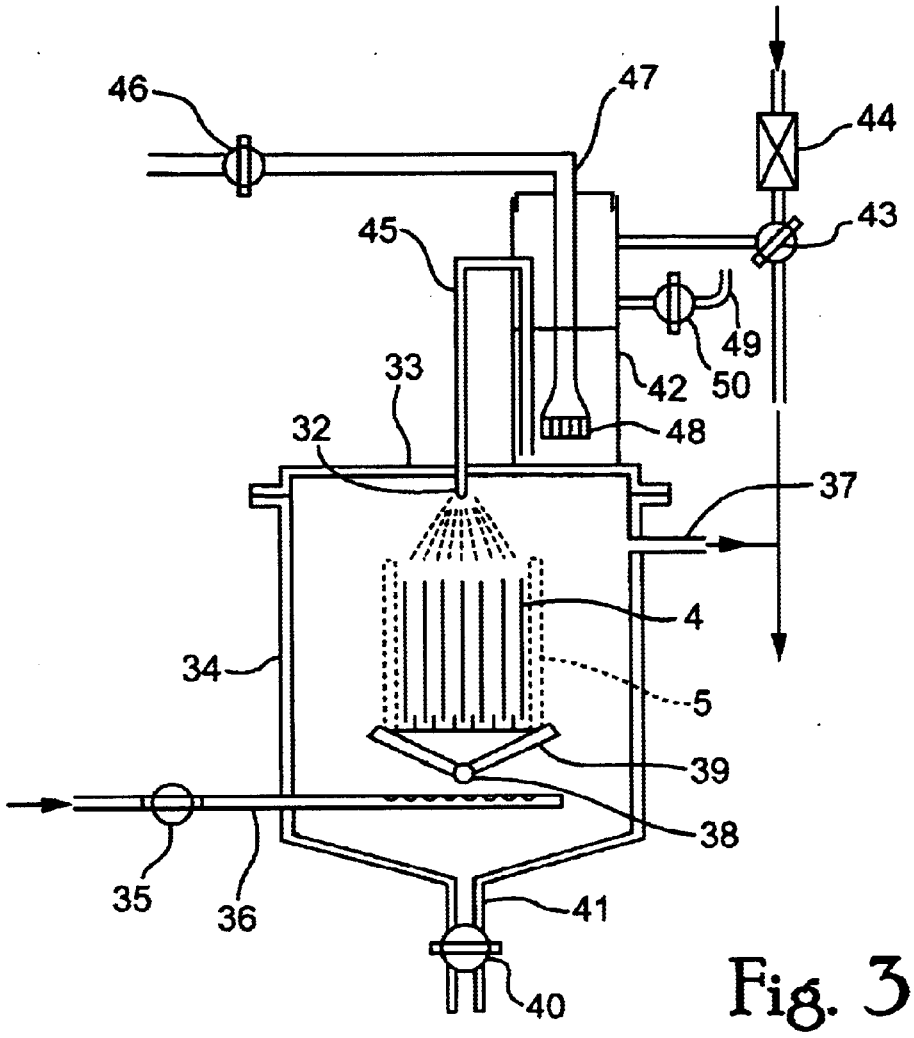
FIG. 3 is a cross-sectional illustration of an apparatus for running-film flow-down type treatment made by spraying an ozone acetic acid solution according to the present invention.

On account of a great resist-dissolving ability of the ozone acetic acid, it was tested to remove the resist by, as shown in FIG. 3, feeding the ozone acetic acid to wafers by means of a nozzle 32 to allow the running film to flow down. A chamber 34 covered with an up and down movable cover 33 is provided with a feed pipe 36 through which ozone gas can be fed by means of a valve 35, and an ozone gas discharge pipe 37, and is also incorporated with a stand 39 on which a carrier 5 holding wafers 4 set therein is slightly swingable around a shaft 38. A valve 40 is provided on a discharge pipe 41 for the acetic acid having participated in treatment, which is closed during the treatment and discharges the acetic acid after the treatment. Ozone gas is fed into the chamber 34 at a rate of 2 L/minute, and also, while the carrier is made to swing the ozone acetic acid is sprinkled from the spray nozzle 32, positioned above the wafers. It is sprayed first continuously until the wafer's whole surfaces become wet, and thereafter intermittently to an extent that the ozone acetic acid drops from the lower ends of the wafers.

The ozone acetic acid is sprayed in the manner that ozone acetic acid held in a absorption container 42 of impinger structure is sent into a spray pipe 45 under pressure of nitrogen through a three-way cock 43 via an electromagnetic valve 44. The ozone acetic acid is prepared by beforehand sending ozone gas through a feed pipe 47 and a perforated nozzle 48 via a valve at a rate of 1 L/minute into acetic acid held in a 500 mL container (not shown), and making the acetic acid absorb the ozone gas. This acetic acid is fed through its feed pipe 49 via a valve 50.

The resists were stripped excluding the sample (5) shown in Example 2. Spray treatment was applied for 10 minutes inclusive of the dwell time during intermittent spraying and in a spray liquid quantity of 20 cc per wafer. Thereafter, only nitrogen-containing oxygen was flowed through the feed pipe 36 to allow the acetic acid on wafers to dry. These wafers were subjected to SC-1 cleaning in the same manner as in Example 2, whereupon the residual organic carbon concentration came to be (3 to 7)$\times10^{12}$ atoms/$cm^2$ in all samples, and the number of fine particles of 0.16 μm or larger was 10 or less on all wafers. The same treatment was made but replacing acetic acid with propionic acid, to find that there was no significant difference in residual organic carbon concentration from the case of acetic acid.

Example 4

The sample (5) in Example 2, i.e., the resist ion-implanted in a dose of $1\times10^{15}/cm^2$ was subjected to ozone acetic acid spray treatment in the same manner as in Example 3 except that 1/200 part by volume of hydrofluoric acid (49% by weight) was added to acetic acid. After intermittent spraying for 10 minute in a spray quantity of 20 cc per wafer, the resist was little removable but turned brittle apparently. This wafer was subjected to high-pressure jet spraying of ultra-pure water, whereupon the water-drop contact angle on the oxide film surface became smaller to 5 degrees or less. On the other hand, as a result of SC-1 cleaning, the residual organic carbon concentration came to be $6\times10^{12}$ atoms/$cm^2$, thus the high-dose ion-implanted resist was removable.

Example 5

Four oxidized wafers of the same type as that used in each of the foregoing Examples were intentionally contaminated with $7\times10^{11}$ atoms/$cm^2$ of Na labeled with $^{22}Na$, $2\times10^{11}$ atoms/$cm^2$ of Ni labeled with $^{57}Ni$, $5\times10^{11}$ atoms/$cm^2$ of Fe labeled with $^{59}Fe$ and $5\times10^{11}$ atoms/$cm^2$ of Cu labeled with $^{64}Cu$, respectively. These were contaminated by causing chlorides of the respective elements to adhere substantially uniformly to the wafer surfaces in the form of aqueous solutions and by an evaporation method designed therefor, followed by dehydration treatment at 140° C. Thereafter, HMDS was coated, and the metal contamination removing ability of hydrofluoric-acid-containing ozone acetic acid treatment was examined on the case where wafers have strong organic contamination.

The same hydrofluoric-acid-containing ozone acetic acid as that in Example 4 was sprayed in the same manner as in Example 3. The spraying was stopped in 3 minutes, and the wafers treated were rinsed with pure water for 1 minute together with the carrier by means of a spin dryer having pure-water rinsing means, followed by drying. The water-drop contact angle became smaller to 4 degrees or less on all wafers, and the methyl silicon layer ascribable to HMDS was found to have substantially been removed. Also, the measurement of radioactivity of the respective wafers revealed that any of the elements was in a residue of $3\times10^9$ atoms/$cm^2$, thus this treatment proved to be effective also for the removal of metal contamination.

Example 6

A wafer of the same type as that used in each of the foregoing Examples was immersed in hydrofluoric acid to remove its oxide film. On its back (the etch-finished side), $1\times10^{11}$ atoms/cm$^2$ of Cu labeled with $^{64}$Cu, capable of radiating γ-rays in a half-life period of 12.8 hours, was adsorbed through dilute hydrofluoric acid, and further on its back $1\times10^{14}$ molecules ($2.4\times10^{15}$ carbon atoms)/cm$^2$ of DOP labeled with $^{14}$C, having a very long half-life period and capable of radiating only β-rays was made to adhere. This sample was subjected to hydrofluoric-acid-containing ozone acetic acid treatment, pure-water rinsing and drying in the same manner as in Example 5, and then γ-rays were measured to find that Cu was in a residue of $2\times10^{9}$ atoms/cm$^2$. Also, on lapse of 1 week after the β-rays had disappeared from $^{64}$Cu, β-rays were measured to determine the residue (quantity) of DOP to find that it was $7\times10^{12}$ atoms/cm$^2$ as carbon concentration. Thus, this ozone acetic acid treatment has a sufficient effect on the removal of contaminants such as organic matters and metals adhering to the back.

Example 7

Figure 4:
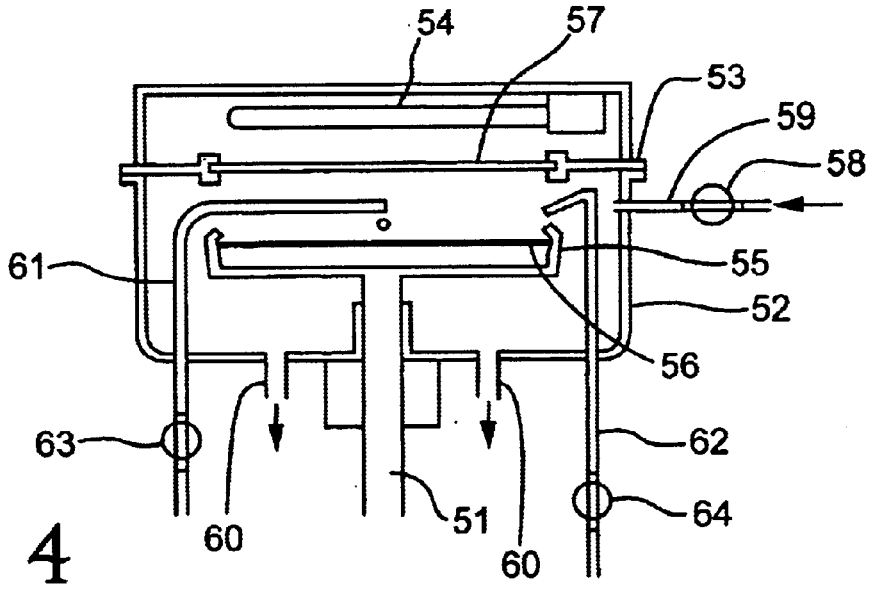
FIG. 4 is a cross-sectional illustration of an apparatus for sheet-by-sheet running-film movement type treatment made by dropping an ozone acetic acid solution according to the present invention.

A sheet-by-sheet cleaner capable of dilute hydrofluoric acid spin cleaning, spin rinsing and spin drying was remodeled to set up a sheet-by-sheet spin ozone acetic acid treating apparatus as shown in FIG. 4. A cover 53 of a chamber 52 having a spin shaft 51 is internally provided with a low-pressure mercury-vapor lamp 54. Three C-200UZ lamps are used in parallel. Part of the cover is formed of a synthetic quarts glass 57 so that 184.9 nm ultraviolet rays of the mercury-vapor lamps may reach without loss the surface of a treating target wafer 56 held with a bearer 55. The chamber 52 has an ozone gas feed pipe 59 through which ozone gas is fed via a valve 58, and a discharge pipe 60. Also attached thereto are an acetic acid feed pipe 61 which rotates only during the ozone acetic acid treatment to drop acetic acid or ozone acetic acid to the center of the wafer and an ultrapure-water feed pipe 62 for carrying out ultrapure-water rinsing after the treatment. The acetic acid and the ultrapure water are flowed in via valves 63 and 64, respectively.

Using this apparatus, resists were stripped from the sample (1), having a resist film of 800 nm thick, and the sample (4), subjected to ashing after ion implantation, shown in Example 2. In each case, the wafer was rotated at a number of revolutions of 100 rpm, and ozone gas with an ozone concentration of 200 mg/L was fed at a rate of 2 L/minute. From the acetic acid feed pipe 61, 200 ppm or higher ozone acetic acid prepared in an ozone absorption container similar to the one shown in Example 3 was flowed into the center. After the whole surface of the wafer became wet, about 80 drops of acetic acid were dropped in 1 minute. Thereafter, ultrapure water was flowed in for 20 seconds to carry out spin rinsing, and then the feeding of ozone was stopped. The wafers thus treated were spin-dried at 4,000 rpm, and thereafter irradiated by ultraviolet rays at 100 rpm for 1 minute. The charged-particle activation analysis of the wafer revealed that the residual organic carbon concentration was $3\times10^{12}$ atoms/cm$^2$ and $5\times10^{12}$ atoms/cm$^2$, respectively, thus both the resist and the methyl silicon layer were well removed.

Example 8

In the apparatus shown in FIG. 4, used in Example 7, the chamber cover 53 was not provided with the low-pressure mercury-vapor lamp so as to merely function as a cover, and meanwhile a dilute hydrofluoric acid feed pipe of the same structure as the ultrapure-water feed pipe 62 was additionally provided. The sample (1), having a resist film of 800 nm thick, shown in Example 2 was subjected to ozone acetic acid treatment and pure-water rinsing in the same manner as in Example 7, and thereafter rinsing with dilute hydrofluoric acid (hydrofluoric acid/water=1 part by volume/50 parts by volume) for 15 seconds and rinsing with pure water for 15 seconds, followed by spin drying in the same manner as in Example 7. The residual organic carbon concentration was $1\times10^{13}$ atoms/cm$^2$, which was on a level a little higher than that in Example 7, but adsorbed molecules were removed to an extent well feasible for practical use in device fabrication.

Example 9

A wafer from which the oxide film was removed as in Example 6 was subjected to SC-1 treatment, and DOP labeled with $^{14}$C and dissolved in hexane was coated on the whole surface. Then, the hexane was made to evaporate rapidly, thus a sample contaminated intentionally with DOP in a concentration of $1\times10^{14}$ molecules/cm$^2$ was prepared.

Using the apparatus used in Example 7, propionic acid with a purity of 99% was fed thereinto through the feed pipe 61, the wafer was subjected to 1 minute treatment, pure-water rinsing and ultraviolet irradiation in entirely the same manner as in Example 7 except that the wafer was rotated at 50 rpm and the drops after the wafer became wet were 50 drops. Measurement of radioactivity made after the treatment was completed revealed that the DOP was in a residue of $2\times10^{11}$ molecules ($5\times10^{12}$ carbon atoms)/cm$^2$, thus DOP was well removable.

Example 10

Figure 5:
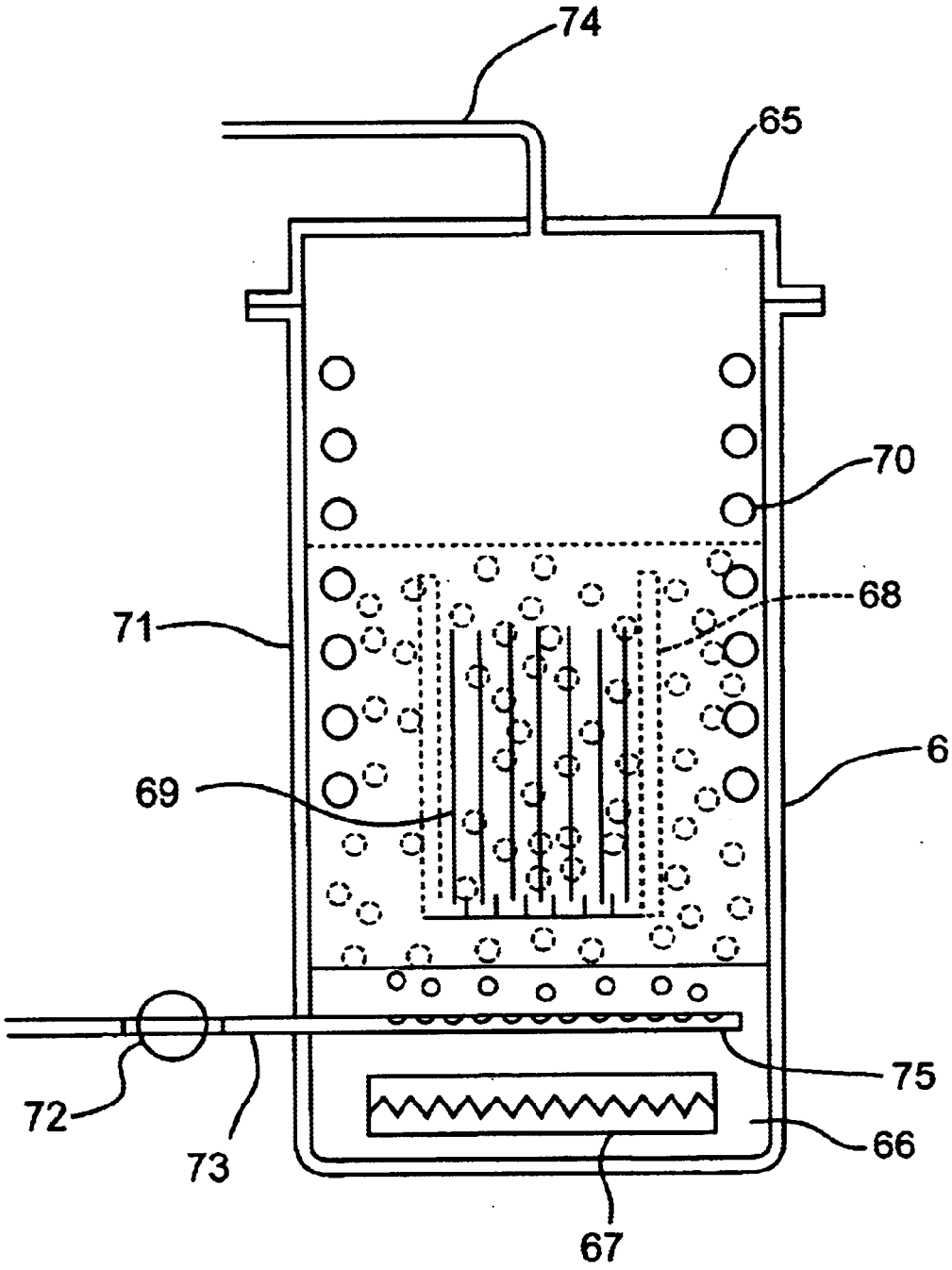
FIG. 5 is a cross-sectional illustration of an apparatus for dichloromethane vapor cleaning in an atmosphere of ozone according to the present invention.

An example in which the running film treatment according to the present invention is made by means of an apparatus having a vapor cleaning mechanism is described with reference to FIG. 5. This apparatus is constituted of a cover 65 set up and down, movable, a heater 67 for heating and vaporizing a dichloromethane solution held at a bottom portion 66, a chamber provided with a cooling pipe 70 for cooling sheet-like glass treating targets 69 put in a carrier 68. This apparatus is characterized by being provided with an ozone gas feed pipe 73 having a valve 72 and with an ozone gas exhaust pipe 74. The feed pipe is, at an end thereof, connected to a perforated pipe 75 for generating fine bubbles of ozone gas in the solution to prepare a mixed gas of ozone and dichloromethane. This apparatus is set up with stainless steel sheets and pipes.

Glass sheets coated with a pitch for lens polishing were set in the carrier 68 as intentionally contaminated samples, and were subjected to vapor cleaning with dichloromethane while ozone gas of about 200 mg/L in concentration was flowed at a rate of 2 L/minute to make comparison with vapor cleaning made using dichloromethane alone. In both cases, glass sheets were brought into dryness in 10 minutes, and their water-drop contact angles were measured to find that contact angles of 30 to 35 degrees in the case of treatment without use of ozone became smaller to about 10 degrees or less. Thereafter, ultraviolet irradiation using C-200UZ was applied for 2 minutes, so that the water-drop contact angle became smaller to 3 degrees. In the case of the articles cleaned with dichloromethane alone, the ultraviolet irradiation had to be applied for 20 minutes or longer.

Example 11

Steel sheets from which oily stains had to be removed as pretreatment for plating were set in the carrier of the apparatus shown in Example 9, and were subjected to vapor cleaning treatment and two-minute ultraviolet treatment in the same manner as in Example 9. As a result, the water-drop contact angle which was 55 degrees before cleaning became smaller to 4 degrees.

Example 12

Figure 6:
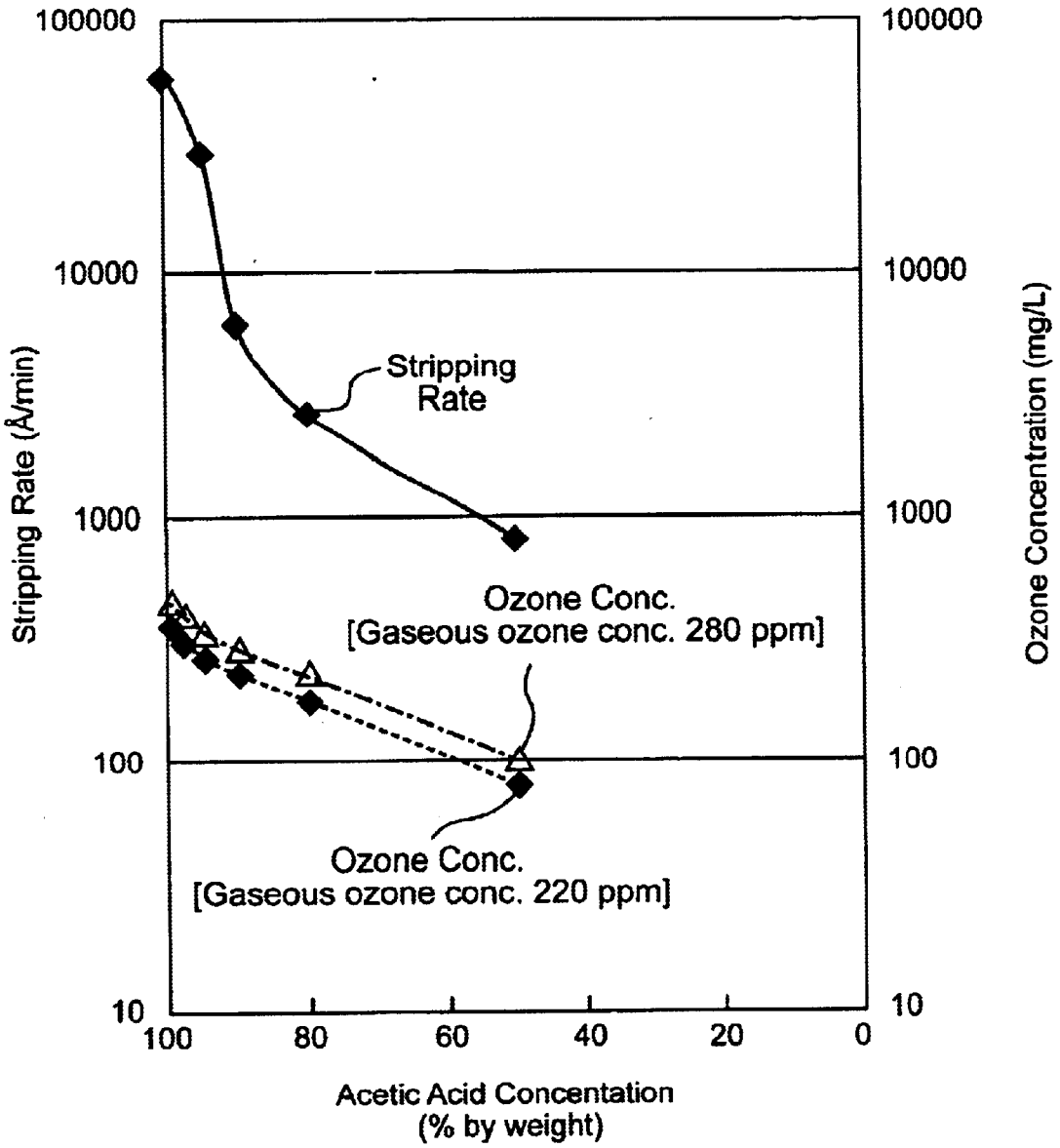
FIG. 6 shows the relationship between acetic acid concentration of hydrous acetic acid and saturated ozone concentration (dotted line: ozone concentration of 220 ppm; dotted chain line: ozone concentration of 280 ppm), and the relationship between acetic acid concentration of ozone-saturated hydrous acetic acid and stripping rate against a novolak resin resist (solid line).

An ozone generator was prepared by which ozone in a high concentration of 200 mg/L to 300 mg/L was obtainable at a flow rate of 0.5 to 1 L/minute. An impinger (capacity: 100 mL) made of quartz glass, provided at a nozzle end with a quartz glass filter, was filled with acetic acid to which water was added in various proportions, where 1% nitrogen-containing oxygen gas containing 220 mg/L of ozone generated by the generator was exhalated to effect bubbling. Considering that ozone stood saturated after 5 minutes, concentrations of ozone dissolved in solutions were measured to obtain the results as shown in FIG. 6. The concentrations are determined by volumetric analysis utilizing the reaction where potassium iodide changes into iodine with ozone. In FIG. 6, a dotted line and a dotted chain line indicate the relationship between acetic acid concentration of hydrous acetic acid and resultant saturated ozone concentration (liquid temperature: 20° C.).

A solid line in FIG. 6 indicates the relationship between acetic acid concentration of ozone-saturated hydrous acetic acid and stripping rate against a novolak resin resist IX555 (available from JSR Corporation). This relationship is determined by an experiment made in the following way.

A wafer with a 100 nm thick oxide film, having been coat-treated with HMDS in the manner as described previously, was coated with the above IX555 in a thickness of 1.5 $\mu$m, followed by baking at 140° C. for 60 seconds to obtain a sample. This sample was cut in a square of 2 cm×2 cm, and was placed at the bottom of a small-size quartz beaker, where 10 mL of the above ozone-saturated acetic acid was added. The beaker was shaked to find the time until the resist was completely stripped in the naked eye examination. From the values thus obtained, the stripping rate was calculated.

As can be seen from FIG. 6, when ozone gas with a ozone concentration of 220 mg/L is used, ozone saturation quantity is 380 mg/L and the stripping rate of acetic acid with a purity of 98% or higher against the novolak resin resist IX555 reaches as high as 6 $\mu$m/minute or more. Thus, in the present invention, where the ozone concentration in acetic acid is close to 400 mg/L, a resist film with a thickness of 1.5 $\mu$m can be removed in a very short time of about 15 seconds.

Example 13

When as shown in Example 12 the concentration of ozone gas is made high and the glass filter is used for exhalating the ozone, acetic acid with a ozone concentration as high as about 400 ppm is obtainable with ease and the novolak resin resist can be removed upon contact for 30 seconds or shorter. Hence, it can be said to be suited to use a sheet-by-sheet spin cleaning mechanism for making the treatment with acetic acid having such a high ozone concentration. Accordingly, using the sheet-by-sheet spin cleaning mechanism shown in Example 7, a resist-removing apparatus as cross-sectionally shown in FIG. 7 was set up.

A treating target wafer 56 in such sheet-by-sheet spin treatment is so set as to be spin-rotated by the driving of its bearer 55 around a spin rotating shaft 51 by means of a rotary mechanism 76, and is surrounded with the wall of a chamber 52 which collects a treating solution that scatters during spin treatment. This sheet-by-sheet treating mechanism, a support stand 78 of a wafer cassette 77 for holding all treating target wafers, and a transport robot 79 which automatically takes the wafer in and out between this cassette 77 and the bearer 55 are provided inside an explosion-proof casing 80. Incidentally, also provided is a mechanism for automatically opening a part 81 of the wall of the chamber 52 when the wafer is taken in and out. The wall of this casing 80 is provided therethrough with a treating solution feed pipe 83 having at its end a nozzle 82 from which ozone acetic acid is released over the wafer surface and an acetic acid feed pipe 85 having at its end a nozzle 84 from which acetic acid for rinsing is released over the wafer surface. Incidentally, this two feed pipes may be put together into one by making operation with a valve.

The wall of the casing 80 is also provided therethrough with a liquid discharge pipe 86 from which acetic acid collected at the bottom of the chamber 52 is discharged, a gas feed pipe 87 for displacing the atmosphere inside the casing, and an ozone exhaust tube 37 through which a gas is sent to an ozone decomposer (not shown) making use of a catalyst such as Mn. Incidentally, the casing is provided with a door 6 which can be opened and closed to take the wafer cassette 77 in and out, and is opened or closed only when the ozone and acetic acid are discharged out of the atmosphere inside th casing.

Ozone acetic acid solution can be prepared by sending ozone gas into acetic acid 88 held in an ozone absorption container 42, from an ozone exhalator 89 making use of quartz glass, through a pipe 59 having a valve 58. Usually, gas-feeding for 5 minutes makes ozone concentration become saturated. This solution is sent to a nozzle 82 for a predetermined time through the feed pipe 83 via a solution feed pump made of Teflon, denoted by P, and through a dusting precision filter denoted by F. The acetic acid is fed to and discharged from the ozone absorption container 42 through a pipe 91 having a valve 90. Acetic acid 92 for rinsing is held in a separate container 93 and is fed through a pipe 95 having a valve 94. The rinsing solution is sent to a rinsing nozzle 84 for a predetermined time through a pipe 85 via a solution feed pump and a dusting precision filter.

Figure 7:
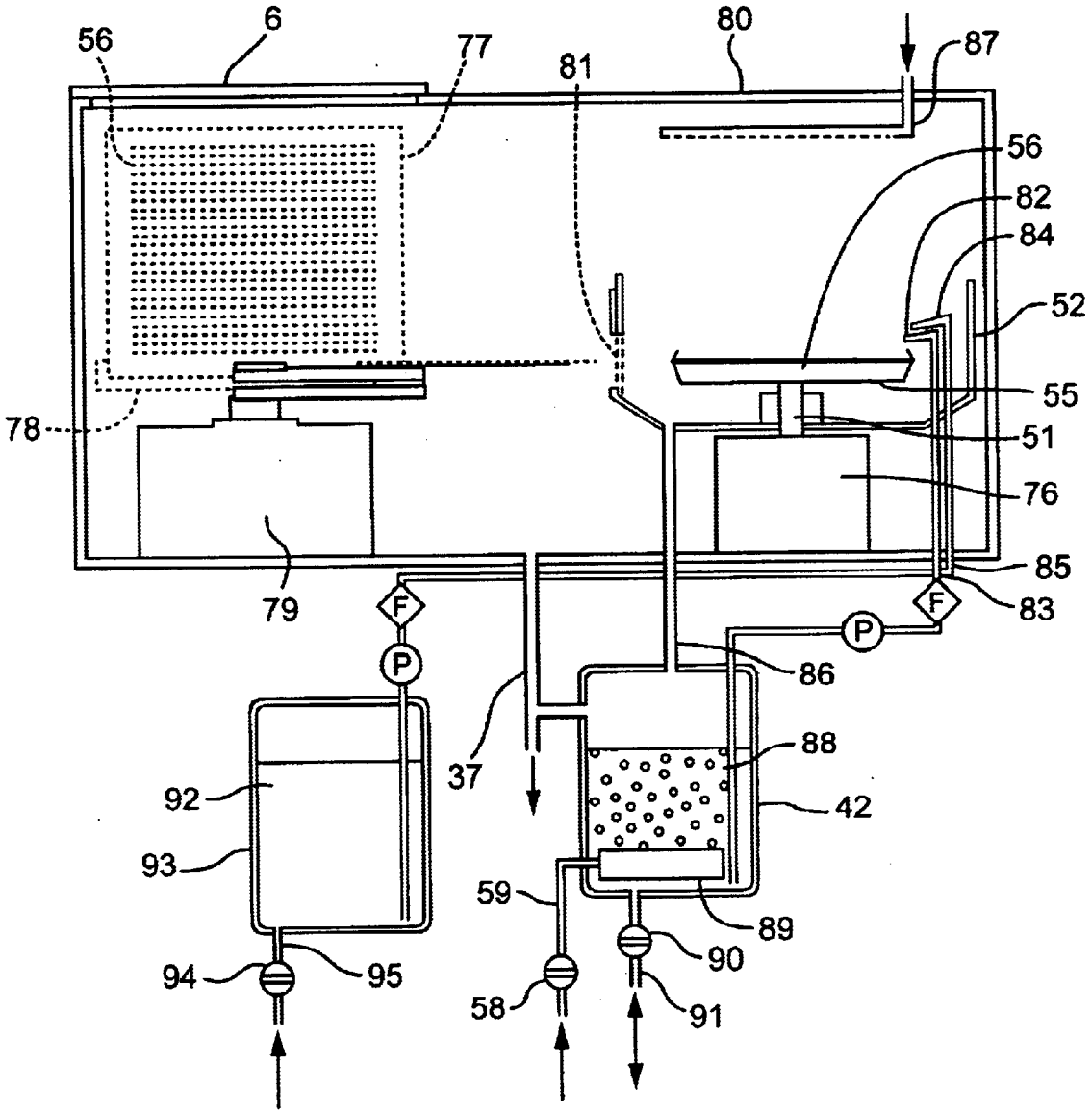
FIG. 7 is a diagrammatic illustration of a resist-removing apparatus according to the present invention.

Six-inch wafers with 100 nm thick oxide films were coated with HMDS and 1.5 $\mu$m thick IX555 photoresist films were further formed, followed by baking at 140° C. for 60 seconds in the manner as described previously, to prepare 25 sheets of wafers. These were put in the cassette 77 and set in the manner as shown in FIG. 7.

The ozone acetic acid reached the highest ozone concentration 380 mg/L in about 5 minutes when about 300 mL of acetic acid was put into the ozone absorption container 42 and nitrogen-containing oxygen with an ozone concentration of 220 mg/L was exhalated from ozone exhalator at a flow rate of 1 L/minute to effect bubbling. The wafer 56 was rotated at 1,000 rpm and the ozone acetic acid was released from the nozzle 82 at a rate of 1.5 mL/second, whereupon the resist of the whole surface was stripped in 15 seconds in the naked eye examination. The ozone acetic acid was further continued to be released for 20 seconds, and the acetic acid held in the acetic acid container 93 was released from the nozzle 84 at a rate of 1.5 mL/minute to effect rinsing for 10 seconds. Then the rotation of the wafer was increased to 4,000 rpm to effect spin drying for 30 seconds. The wafer having been treated was sheet-by-sheet-changed for untreated wafers until 25 sheets of wafers were continuously completely treated, where, although decomposition residues of the resist in the ozone absorption container 42 should have accumulated, the time of about 15 seconds taken until the resist was stripped in the naked eye examination did not change to the last.

The cassette holding the wafers from which resists were all completely stripped was taken out of the casing, and subjected to overflow rinsing with ultrapure water for 10 minutes by means of a conventional cleaning apparatus, followed by spin drying. From these wafers, chips were cut out in a square of 2 cm×2 cm each. Examination of their residual organic carbon concentration by charged-particle activation analysis revealed that it was (0.8 to 2.6)×$10^{13}$ atoms/$cm^2$, thus it was found that not only the resist but also the HMDS film were almost removed.

The reason why any deterioration of the treating solution is not seen in this way is presumed to be that the ozone in a high concentration is always present when waste ozone acetic acid is returned to an ozone saturation container after the sheet-by-sheet treatment and hence the decomposition of resists having dissolved proceeds powerfully until it is purified at a purification level high enough to be reused, and meanwhile the acetic acid little changes even with the high-concentration ozone. More specifically, it can be said that this treatment enables circulating use of the treating solution and acetic acid required anew is only that used for rinsing. The portion of the rinsing solution is little by little discharged by operating the valve 90, since the solution in the ozone absorption container 42 increases. However, the portion having been discharged also contains acetic acid in a high purity, and hence the acetic acid can be recovered by distillation in a very high recovery and can be used for the rinsing.

Example 14

A technetium gas apparatus used for medical diagnosis of the respiratory system is an apparatus which produces an atmosphere of argon in which carbon dust in the form of ultrafine particles of 0.1 $\mu$m or smaller diameter has been dispersed. Such fine particles are labeled with $^{99m}$Tc having a half-life period of 6 hours. Using this apparatus, the film face of the wafer with a resist film used in Example 13 was contaminated, and the radiation dose ascribable to carbon particles adhering to the whole surface was determined by radioluminography using an imaging plate. As a result, radioactivity of 2,600 PSL/$cm^2$ was observable. A sheet-by-sheet laboratory device used exclusively for radiation experiment was set up, and the resist was removed under the like stripping conditions using an acetic acid solution having the same ozone concentration as that in the previous experiment, followed by acetic acid rinsing and then drying. Measurement similarly made by radioluminography revealed that the radiation dose based on residual carbon particles was 20 PSL/$cm^2$ or less of the background. This ozone acetic acid treatment was found to be effective also for the removal of fine particles.

Example 15

The ozone concentration in the ozone acetic acid solution also increases proportionally to the ozone concentration of the gas exhalated into acetic acid, in accordance with the Henry's law. The relationship between acetic acid concentration of hydrous acetic acid and saturated ozone concentration in the case where ozone concentration in the gas is 280 mg/L, is calculated and shown in FIG. 6 by alternate long and short dash lines.

Explosion-proofing of the apparatus becomes unnecessary when acetic acid concentration is lowered to 80% by volume, bringing about many advantages on structure. Even when water content is in such an extent, the ozone concentration in acetic acid comes to be 250 ppm when the ozone concentration in the gas being exhalated is set to be 280 mg/L, and the stripping rate against the novolak resin resist can be about 1 $\mu$m/minute. This enables sheet-by-sheet treatment.

An experiment was made in the same manner as in Example 12 except that the resist film was formed in a layer thickness of 800 nm using novolak resin resist IQ2002 (available from Tokyo Ohka Kogyo Co., Ltd.), the ozone concentration in oxygen was changed to 280 mg/L, the acetic acid was used in an amount of 80% by volume (the remainder was water) in both the containers and the ozone acetic acid was released for a time of 1 minute.

Resist stripping time was 45 seconds on the average in the naked eye examination. Measurement of residual organic carbon concentration revealed that it was all 3×$10^{13}$ atoms/$cm^2$ or less, thus the HMDS layer was removable in its greater part. As a result of SC-1 treatment further made thereafter, the residual organic carbon concentration was 5×$10^{12}$ atoms/$cm^2$ or less, thus a cleanness which could be said too sufficient was attained.

In an attempt that positive resists on oxide films are removed in a semiconductor lithographic process to the level of a residual organic carbon concentration of $10^{13}$ atoms/$cm^2$ or less, inclusive of interfacial methyl silicon layers due to primers HMDS for the resists, conventional methods require to make the piranha treatment under sufficient compositional control and make the SC-1 treatment subsequently. The piranha treatment requires high-temperature treatment at about 130° C., and its solution component $H_2O_2$ decomposes into $H_2O$ to thin the solution to become less effective. Besides, in that course, sulfuric acid turns misty to become scattered to cause an important problem on countermeasures to environmental pollution. In the present invention, ozone treatment is made, and hence, although a hermetically closed system is required, the exhaust ozone gas can readily be decomposed, and also the organic solvent such as acetic acid may less scatter because the treatment is made at room temperature. Also, when acetic acid is used, it can be recovered by cooling prior to decomposition treatment. In the present invention, the ozone acetic acid solution after cleaning treatment may be returned to the ozone dissolution (absorption) solution bubbled with ozone. Since ozone has a high ability of decomposing target contaminants as exemplified by novolak resin resists, in the case of such resists, the resin and a photosensitive-agent naphthoquinone azide decompose into glyoxal and glyoxylic acid, the former being via maleic acid or the like from muconic acid and the latter being via phthalic acid or the like, and finally decompose from formic acid to water and carbon dioxide. Namely, in the course of this bubbling with ozone, purification is effected and the acetic acid is used over a long lifetime. In short, the organic solvent is purified with ozone, and may be used in a very small quantity to bring about an economically advantageous effect, whereas other resist removers merely dissolved may deteriorate as a result of accumulation of dissolved matters. Hence, in the present invention, both ozone and such an organic solvent make it easy to take countermeasures to environmental pollution. In particular, acetic acid has so weak a toxicity as to promise a high safety.

In addition, compared with the piranha treatment and conventional ozone treatment, the treatment method of the present invention can achieve a stripping rate against such resists which is higher by one figure to two figures. This is because the organic solvents used in the present invention have an ozone solubility about 10 times that of water, and also these organic solvents may hardly decompose with ozone. Also, these organic solvents have a small surface tension and can readily spread over treating target surfaces, and hence the treating target surfaces can be treated in a good efficiency by means of the organic solvent running film with a high ozone concentration. Hence, they can be treated in a small liquid quantity, and the running film treatment is made in an atmosphere of ozone in order to maintain the ozone concentration in the running film at a level as high as possible. Thus, the ozone gas also may be used in a smaller quantity than the case of the ozone water treatment.

The treatment by the present invention has a very high ability of stripping positive resists, and hence a chemical action (embrittlement) can be provided that is good enough to be able to readily dissolve the resist $B^+$ ion-implanted in a dose of $1\times10^{14}/cm^2$, and even dissolve the resist $B^+$ ion-implanted in a dose of $1\times10^{15}/cm^2$ as long as high-pressure jet spray cleaning is subsequently carried out. In the case of the resist whose ion-implanted layer has been subjected to ashing, it is also possible to remove it by the sheet-by-sheet treatment with ozone acetic acid solution for 1 minute. Moreover, since the solution has a small surface tension, in the step of fabricating devices having fine patterns, the resist can effectively be removed up to every corner of the patterns, and fine particles can also be well removed. Also, because of acid treatment having a strong oxidizing power attributable to the high ozone concentration, metal contamination can also be removed. Thus, the present invention can be effective for removing various contaminants and also provides an advantage as a cleaner.

Molecules of carboxylic acids such as acetic acid are ionized during the pure-water rinsing made subsequently. Ionized molecules of these tend to be oxidized. For example, in ultraviolet ozone treatment, they decompose to disappear in a very shot time. Besides, they do alike also in alkali-hydrogen peroxide treatment. Thus, the present invention has a cleaning effect by which the surface organic carbon concentration is made to reach the order of $10^{12}$ atoms/$cm^2$.

The running film treatment by moving an ozone organic solvent in an atmosphere of ozone according to the present invention can be applied with ease to vapor cleaning with dichloromethane, as having a high ozone solubility and a small surface tension and also having a relatively low toxicity. This treatment, when made in combination with short-time ultraviolet ozone treatment, has the effect of simplifying high-level removal of contaminants such as organic matters when adhesion of water is not preferable.

What is claimed is:

1. A method of removing organic contaminants deposited on a surface of a substrate of an electronic device, comprising bringing a treating solution into contact with said surface, wherein said treating solution comprises:

a solvent having a concentration of at least 70% by volume of acetic acid and the remaining balance of water, and at least 100 ppm of ozone dissolved in said solvent.

2. The method according to claim 1, which comprises feeding said treating solution continuously or intermittently onto the surface of the substrate such that said treating solution flows on said surface in the form of a film.

3. The method according to claim 1, which comprises feeding said solvent, continuously or intermittently, on the surface of the substrate in an ozone-containing gas, wherein ozone in the gas is dissolved in said solvent to form said treating solution containing ozone dissolved therein in a concentration of at least 100 ppm, and whereby the treating solution thus formed flows on said surface in the form of a film.

4. The method according to claim 1, wherein at least 200 ppm of ozone is dissolved in said solvent.

5. The method according to claim 2, which comprises spraying the treating solution on said surface of the substrate.

6. The method according to claim 3, which comprises spraying said solvent on said surface of the substrate in said ozone-containing gas.

7. The method according to claim 3, which comprises heating said solvent to form a vapor thereof, feeding the vapor thus formed onto the surface of the substrate, wherein the surface of said substrate is cooled, and allowing the vapor to condense into the liquid state on the surface of the substrate.

* * * * *

UNITED STATES PATENT AND TRADEMARK OFFICE

CERTIFICATE OF CORRECTION

PATENT NO. : 6,699,330 B1
DATED : March 2, 2004
INVENTOR(S) : Hisashi Muraoka

It is certified that error appears in the above-identified patent and that said Letters Patent is hereby corrected as shown below:

Title page,
Item [73], Assignee, replace "Nomura Micro Science Co., Ltd." with -- Nomura Micro Science Co., Ltd. and UMS Co., Ltd. --.

Signed and Sealed this

Thirteenth Day of July, 2004

JON W. DUDAS
*Acting Director of the United States Patent and Trademark Office*